United States Patent [19]

Jeschke

[11] 3,966,192

[45] June 29, 1976

[54] SHEET PILE ELEVATOR IN SHEET DELIVERY SYSTEMS FOR PRINTING MACHINES

[75] Inventor: Willi Jeschke, Heidelberg, Germany

[73] Assignee: Heidelberger Druckmaschinen Aktiengesellschaft, Heidelberg, Germany

[22] Filed: Sept. 27, 1974

[21] Appl. No.: 509,945

Related U.S. Application Data

[63] Continuation of Ser. No. 421,769, Dec. 3, 1973, abandoned, which is a continuation of Ser. No. 231,437, March 2, 1972, abandoned, which is a continuation of Ser. No. 29,040, April 16, 1970, abandoned.

[30] Foreign Application Priority Data

May 3, 1969 Germany ..... 1922694

[52] U.S. Cl. ..... 271/147; 271/30 R

[51] Int. Cl.[2] ..... B65H 1/14

[58] Field of Search .... 271/30 R, 31, 147, 152–160, 271/126, 128, 130; 214/8.5 A

[56] References Cited

UNITED STATES PATENTS

| | | | |
|---|---|---|---|
| 912,563 | 2/1909 | Gustafson | 271/159 |
| 1,560,470 | 11/1925 | Hitchcock | 271/147 |
| 2,734,744 | 2/1956 | Backhouse | 271/159 |
| 3,226,112 | 12/1965 | Kuever | 271/157 |
| 3,565,217 | 2/1971 | St. Louis | 187/27 |

*Primary Examiner*—Richard A. Schacher
*Assistant Examiner*—Bruce H. Stoner, Jr.
*Attorney, Agent, or Firm*—Herbert L. Lerner

[57] ABSTRACT

Sheet pile elevator in a sheet delivery system of a printing machine having a sheet pile table located within a framework of the sheet delivery system includes a short shaft stub mounted on the framework above each of the corners of the sheet pile table and carrying a rotary guide roller, a lifting chain articulatingly secured at each of the corners of the table and extending upwardly and over a respective guide roller, and a sprocket wheel for each of the lifting chains located at one side of the table and mounted in common on a single drive shaft having a rotary axis extending in a direction wherein sheets piled on the table are feedable therefrom for processing, the lifting chains having a free end, respectively, leading to a respective sprocket wheel.

2 Claims, 3 Drawing Figures

SHEET PILE ELEVATOR IN SHEET DELIVERY SYSTEMS FOR PRINTING MACHINES

This application is a continuation of Ser. No. 421,769 filed Dec. 3, 1973, now abandoned, which is a continuation of Ser. No. 231,437, filed Mar. 2, 1972, now abandoned, which is a continuation of Ser. No. 29,040, filed Apr. 16, 1970, now abandoned.

My invention relates to sheet pile elevator in sheet delivery systems for printing machines wherein lifting chains driven by sprocket wheels are articulatingly secured to a sheet pile table, the rotary shafts of the sprocket wheels, both at the driving side as well as the servicing side of the sheet delivery system are mounted so that they extend in the direction in which sheets piled on the table are feedable therefrom for processing.

In the heretofore known sheet pile elevators of the aforementioned type, continuous shafts are provided at both sides of the sheet delivery system, above the plane in which the sheets are processed, the sprocket wheels for the four lifting chains being secured thereon. Both shafts are driven in common by a drive shaft extending transversely over the sheet delivery system. These known sheet pile elevators have a great disadvantage in that the continuous shaft of the sprocket wheels provided at the servicing side of the sheet delivery system obstructs the view of the sheet delivery system parts that are vital for effecting transfer of the sheets and therefore obstructs or renders more difficult the serviceability thereof (U.S. Pat. Nos. 1,617,734; 2,474,141; and 2,650,092).

It is accordingly an object of my invention to provide sheet pile elevator in a sheet delivery system for printing machines whose observation and accessibility are considerably improved over those of the heretofore known sheet pile elevators, and it is furthermore an object of the invention to provide such sheet pile elevator which does not require framework parts at the servicing side thereof in the vicinity of the upper edge of the sheet pile.

With the foregoing and other objects in view, I provide in accordance with my invention, sheet pile elevator in a sheet delivery system of a printing machine having a sheet pile table located within a framework of the sheet delivery system, comprising a short shaft stub mounted on the framework above each of the corners of the sheet pile table and carrying a rotary guide roller, a lifting chain articulatingly secured at each of the corners of the table and extending upwardly and over a respective guide roller, and a sprocket wheel for each of the lifting chains located at one side of the table and mounted in common on a single drive shaft having a rotary axis extending in a direction wherein sheets piled on the table are feedable therefrom for processing, the lifting chains having a free end, respectively, leading to a respective sprocket wheel.

The driving of the lifting chains by a drive shaft provided at the driving side of the sheet delivery system, the lifting chains located at the servicing side of the pile table being guided from the respective guide rollers thereof over the sheet pile to the drive sprocket wheels, permits mounting of the guide rollers on short shaft stubs which renders superfluous the need for a continuous shaft as well as a side wall for carrying and protecting the same, which tend to obstruct the view and servicing of the sheet delivery system.

Other features which are considered as characteristic for the invention are set forth in the appended claims.

Although the invention is illustrated and described herein as embodied in sheet pile elevator in sheet delivery systems for printing machines, it is nevertheless not intended to be limited to the details shown, since modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
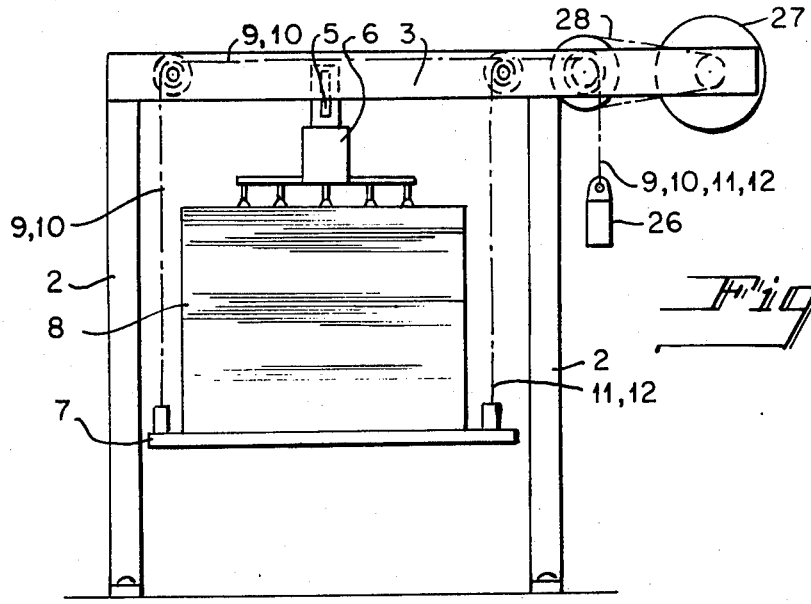
FIG. 1 is a diagrammatic elevational view of a sheet delivery system with a sheet pile elevator constructed in accordance with the invention.
Figure 2:
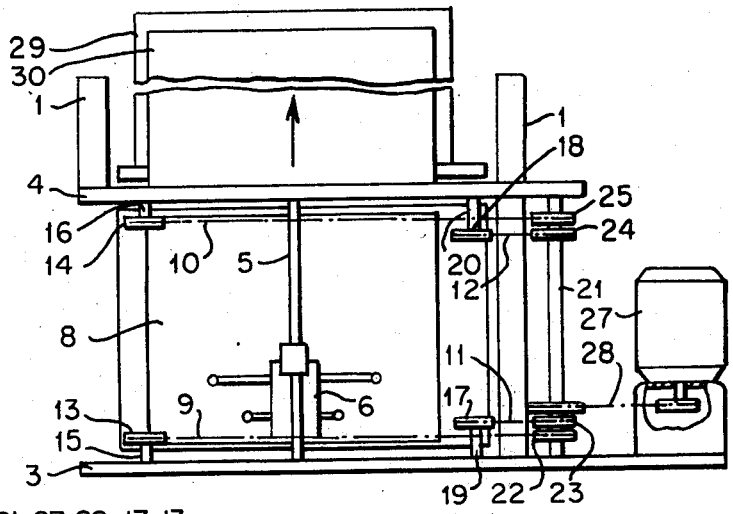
FIG. 2 is a top plan view, partly broken, of FIG. 1.

Referring now to the drawings, there is shown a sheet delivery system of a printing machine formed essentially of side walls 1 and a framework construction with vertically extending supports 2, a forward transverse beam 3 as well as a rearward transverse beam 4. Both transverse beams 3 and 4 are connected to one another by a longitudinally extending beam 5. A suction head 6 from which a plurality of branching suction tubes, as shown in FIGS. 1 and 2, extend, is mounted on the longitudinal beam 5, which extends in the direction in which sheets of paper, or the like, formed in a pile 8 on a sheet pile table 7 are transferable by the suction device 6 in the direction of the associated arrow in FIG. 2 for processing. The sheet pile table 7 is suspended on four carrying or lifting chains 9 through 12, all four of the lifting chains being articulatingly fastened to the sheet pile table 7 readily releasable therefrom. The lifting chains 9 and 10 are located at the side of the sheet delivery system from which the latter is serviced by operating personnel, and extend vertically upward and are passed over respective guide rollers 13 and 14. The guide roller 13 is rotatably mounted on a short shaft stub 15 extending from the transverse beam 3, while the guide roller 14 located opposite thereto is mounted on a short shaft stub 16 extending from the rearward transverse beam 4.

At the driving side of the sheet delivery system, the lifting chains 11 and 12 extend vertically upwardly and are passed over respective guide rollers 17 and 18. The guide roller 17 is rotatably mounted on a short shaft stub 19 extending from the forward transverse beam 3, and the guide roller 18 is rotatably mounted on a short shaft stub 20 extending from the rearward transverse beam 4. The axes of symmetry of the four shaft stubs 15, 16, 19 and 20 and, accordingly, the rotary axes of the guide rollers 13, 14, 17 and 18 extend parallel to the direction in which the sheets are feedable for further processing i.e. in the longitudinal direction of the sheet delivery system represented by the arrow in FIG. 2. At the driving side of the sheet delivery system i.e. the right-hand side of FIGS. 1 and 2, there is rotatably mounted a drive shaft 21, one end of which being mounted in a suitable bearing in the forward transverse beam 3 and the other end similarly in a suitable bearing in the rearward transverse beam 4. The drive shaft 21 extends parallel to the axes of symmetry of the shaft stubs 15, 16, 19 and 20, and four drive sprocket wheels 22 through 25 are mounted thereon. One of the lifting chains 9 through 12 passes respectively over one of the sprocket wheels 22 through 25. Thereby, the lifting chains 9 and 10 extend from the servicing side at the left-hand side of the sheet delivery system, as viewed in FIGS. 1 and 2, over the sheet pile 8. The free ends of the four lifting chains 9 through 12 are hung vertically downwardly from the drive sprocket wheels 22 through 25 and are loaded with a respective weight 26, only one of which is shown in FIG. 1.

The forward transverse beam 3 of the sheet delivery system carries a drive motor 27 at the driving side of the sheet delivery system, the drive shaft 21 being driven by a chain drive 28 extending from the drive motor 27.

Figure 3:
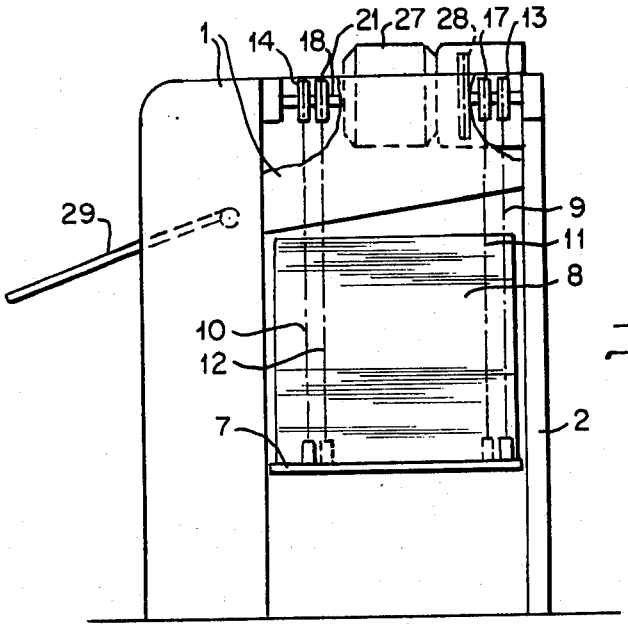
FIG. 3 is a side view from the left-hand side of FIG. 1, the suction head for transferring the sheets being omitted in the interest of clarity.

As can be readily seen in FIGS. 2 and 3, a delivery table 29, in a conventional manner, is connected to the sheet delivery system for further advancing to a non-illustrated printing mechanism the sheets 30 fed thereto by the suction head 6 from the sheet pile 8 carried by the table 7.

The operation of the aforedescribed device of my invention is as follows:

The drive motor 27 drives the sheet pile table 7, in accordance with the consumption of a pile of sheets stacked thereon, until the table 7 reaches the floor or ground as shown in FIGS. 1 and 3, so that a new sheet pile 8 can be stacked on the thus lowered table 7 to replace the depleted previous sheets that had been stacked thereon. Thereafter, the motor 27 raises the sheet pile table 7 to a height at which the uppermost sheet 30 of the pile 8 is disposed in the operating plane of the suction head 6. The lifting chains 9 through 12 are rotatably formed as roller chains so that an exact lifting of the sheet pile is assured. Depending upon the speed of processing of the sheets 30 by, for example, a non-illustrated printing plant or mechanism, the motor 27 raises the sheet pile table 7 periodically so that the respective uppermost sheet 30 of the sheet pile 8 is always disposed in the processing plane of the suction head 6. If for reasons of space economy, the sheet pile 8 cannot be deposited on the sheet pile table 7 from the rear side of the sheet delivery system i.e. the lower side of FIG. 2, but rather from the servicing side i.e. from the left-hand side of FIGS. 1 and 2, the lifting chains 9 and 10 formed of roller chains which are articulatingly connected to the sheet pile table 7 and readily releasable therefrom, are able to be swung up high so as to permit a sheet pile to be driven onto the table 7. During the installation of the new sheet pile 8 on the sheet pile table 7 as well as during the processing thereof, such as the imprinting of the sheets 30 from the sheet pile 7, operating personnel have unobstructed access from the servicing side of the sheet delivery system, namely the left-hand side of FIGS. 1 or 2, to the transfer members, such as the suction head 6, of the sheet delivery system, because the personnel are not blocked or hampered by any chain sprocket shaft extending continuously in the longitudinal direction of the sheet delivery system or any side wall supporting that shaft.

A particular advantage of the device of my invention is that in spite of the use of precise roller chains, the sheet pile can be shifted or adjusted in a relatively simple manner in lateral direction into a desired position thereof with respect to the suction head 6 because the rotary axes of the roller chain joints extend parallel to the direction in which the sheets 30 are being displaced for processing and thereby permit a displacement of the sheet pile table 7 transversely to the direction in which the sheets 30 are displaced for processing i.e. in the longitudinal direction of the beam 5 or the arrow shown in FIG. 2. The advantageous swingability of the roller chain joints or links is a result of the location or position of the rotary axes of the guide rollers 13, 14, 18 and 19. As mentioned hereinabove, these rotary axes extend in the direction in which the sheets 30 are being advanced for processing.

I claim:

1. Sheet pile elevator in a sheet delivery system of a printing machine having a substantially rectangular sheet pile table located within a framework of the sheet delivery system, comprising a plurality of shaft stubs, each of said stubs being mounted on the framework above each of the corners of the sheet pile table, said stubs having a length that is short compared to the width of the table and carrying a respective rotary guide roller, said shaft stubs having symmetry axes and said guide rollers having rotary axes extending in a direction wherein sheets piled on the table are feedable therefrom for processing, a plurality of lifting roller chains articulatingly secured at one end thereof to each of the corners of the table and extending upwardly and over said guide rollers, respectively, the roller chain joints of said roller chains having rotary axes extending parallel to the direction in which the sheets are being fed, so that the table is laterally adjustable, a single drive shaft for rotating all of said guide rollers simultaneously so as to drive all of said lifting chains simultaneously, said shaft being located at a first side of the table and having a rotary axis extending in said direction, the sheets piled on the table being feedable therefrom for processing, a sprocket wheel for each of said lifting chains mounted in common on said single drive shaft at said first side of the table, said lifting chains having a free end, respectively, leading to a respective sprocket wheel, the table framework and said chains being arranged so that a pile of sheets may be fed onto the table from a second side thereof and components of the sheet delivery system overlying the table are accessible to servicing personnel from a third side of the table which is disposed substantially perpendicularly to said second side thereof, the sheets piled on the table being feedable for processing in said direction over a fourth side of the table disposed substantially at right angles to said first side of the table, whereby the sheets being fed are easily inspectable and the view and serviceability of the sheet delivery system remains unobstructed.

2. Sheet pile elevator according to claim 1, including means for driving said drive shaft located at said first side of the table, said driving means comprising a drive motor having a rotary shaft extending in said direction wherein sheets piled on the table are feedable therefrom for processing, said third side of said table located opposite said first side of the table being unobstructed to afford accessibility of servicing personnel to said sheet delivery system.

* * * * *